US009726181B2

(12) United States Patent
Takahashi et al.

(10) Patent No.: US 9,726,181 B2
(45) Date of Patent: Aug. 8, 2017

(54) CENTRIFUGAL PUMP

(71) Applicant: Honda Motor Co., Ltd., Tokyo (JP)

(72) Inventors: Yoshihiro Takahashi, Wako (JP); Takahide Konchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 365 days.

(21) Appl. No.: 14/476,939

(22) Filed: Sep. 4, 2014

(65) Prior Publication Data

US 2015/0071773 A1 Mar. 12, 2015

(30) Foreign Application Priority Data

Sep. 6, 2013 (JP) ..... 2013-185212

(51) Int. Cl.
*F04D 29/18* (2006.01)
*F04D 9/02* (2006.01)
(Continued)

(52) U.S. Cl.
CPC ..... *F04D 9/02* (2013.01); *F04D 29/245* (2013.01); *F04D 29/4293* (2013.01);
(Continued)

(58) Field of Classification Search
CPC ..... F04D 9/002; F04D 9/02; F04D 29/167; F04D 29/426; F04D 29/448; F04D 29/24;
(Continued)

(56) References Cited

U.S. PATENT DOCUMENTS 3,027,845 A * 4/1962 Gilman ..... F04D 29/24 415/204
3,964,840 A 6/1976 Kamelmacher
(Continued)

FOREIGN PATENT DOCUMENTS

CN 37201871 U 6/1988
CN 1354329 A 6/2002
(Continued)

OTHER PUBLICATIONS

Office Action and Search Report dated May 4, 2016, issued in counterpart Chinese Patent Applicatiion No. 201410453665.8, with English translation. (16 pages).
(Continued)

*Primary Examiner* — Kenneth Bomberg
*Assistant Examiner* — Brian Delrue
(74) *Attorney, Agent, or Firm* — Westerman, Hattori, Daniels & Adrian, LLP

(57) ABSTRACT

An impeller includes a disk-shaped hub and a plurality of vanes provided radially on the surface of the hub. The plurality of vanes are formed in a whirling pattern about the center of rotation of the impeller, and each of the vanes has an outer peripheral surface facing the inner peripheral surface of the volute. A rotational-direction rear end portion of the outer peripheral surface of each of the vanes has a recessed step surface formed thereon. The rotational-direction rear end of the recessed step surface of each of the vanes is formed to define an edge shape with respect to a rotational-direction rear end surface of the vane.

2 Claims, 11 Drawing Sheets

(51) Int. Cl.
*F04D 29/42* (2006.01)
*F04D 29/24* (2006.01)
*F04D 29/66* (2006.01)

(52) U.S. Cl.
CPC ..... *F04D 29/669* (2013.01); *F05D 2240/304* (2013.01); *F05D 2250/294* (2013.01)

(58) Field of Classification Search
CPC .. F04D 29/242; F04D 29/245; F04D 29/4293; F05D 2240/126
USPC ..... 415/204
See application file for complete search history.

(56) References Cited

U.S. PATENT DOCUMENTS

| | | | | |
|---|---|---|---|---|
| 2010/0226773 | A1* | 9/2010 | Bruhn | F04D 29/2222 416/87 |
| 2012/0253103 | A1* | 10/2012 | Robert | A61M 1/101 600/16 |
| 2014/0169940 | A1* | 6/2014 | Yokota | F04D 9/005 415/56.1 |

FOREIGN PATENT DOCUMENTS

| | | | | |
|---|---|---|---|---|
| CN | 2727453 | Y | 9/2005 | |
| DE | 139742 | A1 | 1/1980 | |
| EP | 1219838 | A2 | 7/2002 | |
| FR | 1025250 | A | 4/1953 | |
| IT | 1219838 | A2 * | 7/2002 | F04D 1/063 |
| JP | 56-124699 | A | 9/1981 | |
| JP | 62-111989 | U | 7/1987 | |
| JP | 64-073165 | A | 3/1989 | |
| JP | 2012-72697 | A | 4/2012 | |
| JP | 2012-72701 | A | 4/2012 | |

OTHER PUBLICATIONS

Office Acton dated Aug. 23, 2016, issued in counterpart Japanese Patent Application No. 2013-185212, with English translation. (7 pages).

* cited by examiner (b)
INVENTIVE EMBODIMENT (a)
CONVENTIONALLY-KNOWN EXAMPLE (b)
INVENTIVE EMBODIMENT (a)
CONVENTIONALLY-KNOWN EXAMPLE

CENTRIFUGAL PUMP

TECHNICAL FIELD

The present disclosure relates generally to centrifugal pumps in which an impeller is provided within a volute and fluid sucked into the volute by rotation of the impeller is discharged to outside of the centrifugal pump.

BACKGROUND

Among the conventionally-known centrifugal pumps are ones in which a rotation shaft rotatably projects into a volute and an impeller is mounted on the projecting rotation shaft. By rotation of the impeller, fluid present inside the volute is sent out from the volute. During rotation of the impeller, pushing force acts on water present forward in a traveling (rotating) direction of vanes of the impeller, so that local high pressure is developed on the front sides of the vanes. On the reverse sides of the vanes, on the other hand, pulling force acts on water, so that local low pressure is developed on the reverse sides. Thus, there would occur so-called "cavitation" involving decompression boiling that causes air bubbles. A technique addressing such cavitation is known, for example, from Japanese Patent Application Laid-open Publication No. SHO-64-73165 (hereinafter referred to as "relevant patent literature").

According to the technique disclosed in the relevant patent literature, the impeller has a plurality of vanes extending radially outward from the rotation shaft and slightly slanted in the rotational direction of the rotation shaft. Each of the vanes has a generally straight shape with a distal end portion slanted on its front surface oriented forward in the rotational direction of the vane. With such a slanted surface, rapid changes in flows of water, and hence occurrence of cavitation, at the distal end portions of the vanes can be suppressed.

During self-priming operation in self-priming centrifugal pumps, the self-priming is performed by sucking in air through swirling flows developed at end portions of the impeller vanes. With the impeller disclosed in the relevant patent literature, however, water flows are smoothed by the slanted surfaces of the vanes, and thus, the swirling flows developed at the end portions of the impeller vanes would decrease. Consequently, an amount of air sucked in from the volute would decrease, which undesirably results in lowered self-priming performance of the pump.

SUMMARY

In view of the foregoing problems, it is preferable to provide an improved centrifugal pump which can not only effectively suppress occurrence of cavitation but also achieve enhanced self-priming performance.

In order to accomplish the above, one aspect of the present disclosure provides an improved centrifugal pump which comprises a volute provided within a pump casing, and an impeller rotatably provided within the volute, fluid sucked into the volute through rotation of the impeller being sent from the volute into the pump casing and then discharged to outside of the pump casing, the impeller including a disk-shaped hub and a plurality of vanes provided radially on a surface of the hub, the plurality of vanes being formed in a whirling pattern about the center of rotation of the impeller, each of the vanes having an outer peripheral surface facing the inner peripheral surface of the volute, a rotational-direction rear end portion of the outer peripheral surface having a recessed step surface formed thereon.

Because the rotational-direction rear end portion of the outer peripheral surface of each of the vanes has the recessed step surface formed thereon, swirling flows can be developed at a boundary portion of the outer peripheral surface where the outer peripheral surface starts switching to the recessed step surface and at a rear end portion of the recessed step surface. Thus, great swirling flows can be developed to entrain air present within the volute, as a result of which the present disclosure can achieve enhanced self-priming performance.

Further, because the rotational-direction rear end portion of the outer peripheral surface in each of the vanes has the recessed step surface formed thereon, stoppage of fluid can be alleviated in a stepwise fashion over a region where the vane progressively approaches the inner peripheral surface of the volute, so that occurrence of cavitation can be suppressed. Namely, the present disclosure can not only effectively suppress occurrence of vibration but also achieve enhanced self-priming performance.

In an embodiment of the present invention, the rotational-direction rear end of the recessed step surface of each of the vanes is formed to define an edge shape with respect to a rotational-direction rear end surface of the vane. With such an arrangement, the embodiment can develop great swirling flows by changing fluid flows, thereby even further enhancing the self-priming performance.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
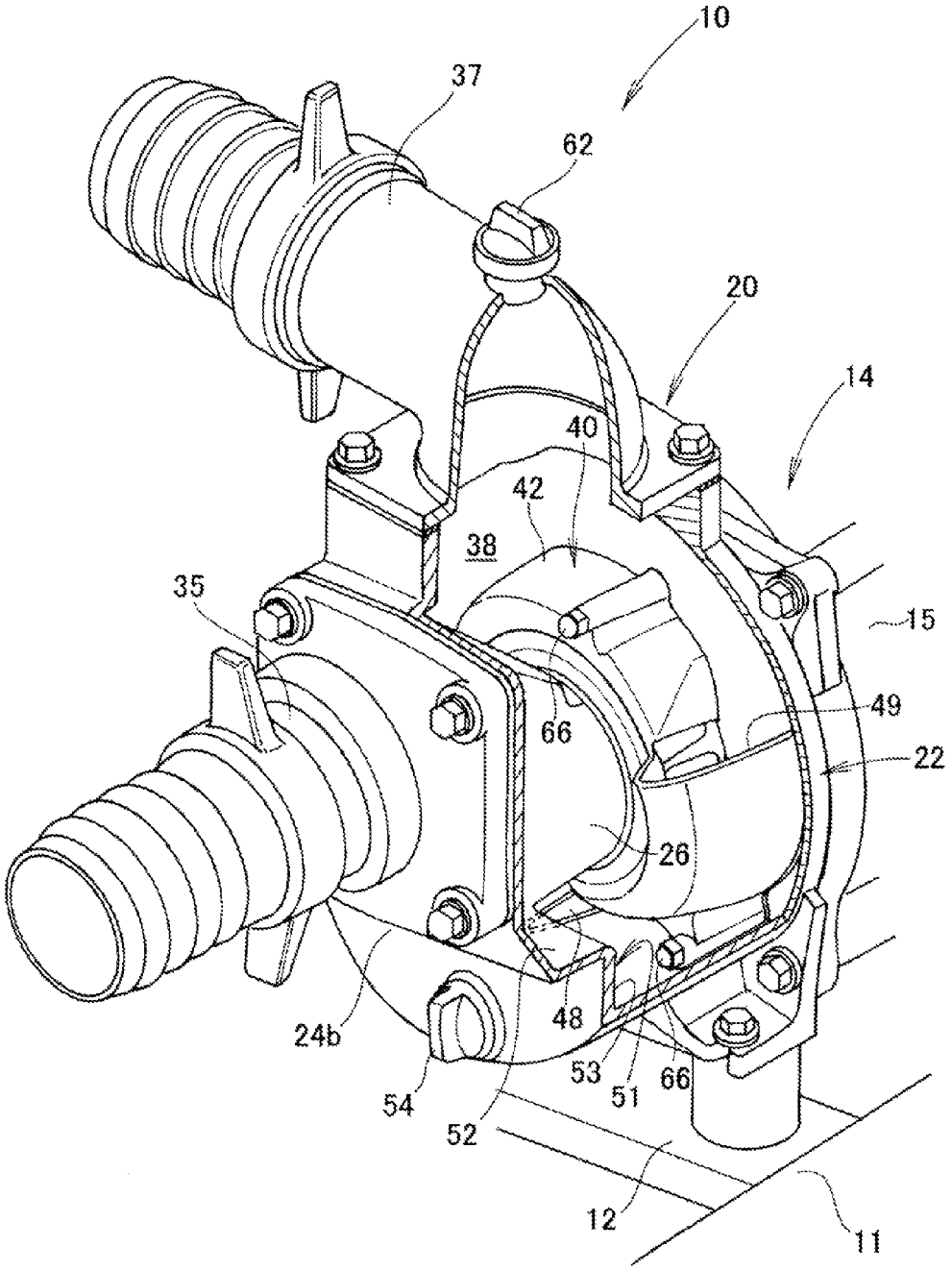
FIG. 1 is a perspective view showing an embodiment of a centrifugal pump of the present invention.
Figure 2:
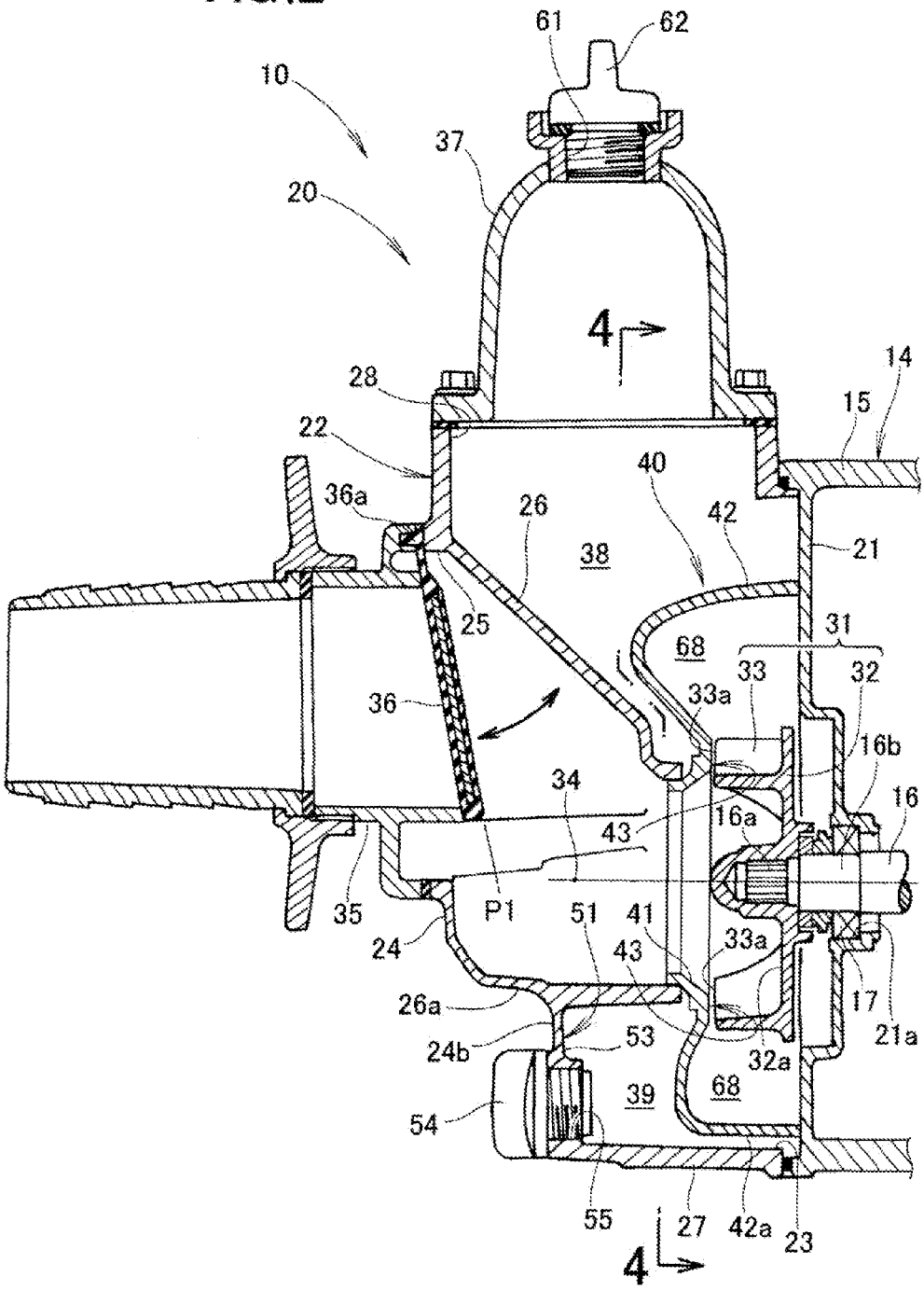
FIG. 2 is a sectional view of the centrifugal pump shown in FIG. 1.

Now, a description will be given about an embodiment of a centrifugal pump 20 of the present invention. As shown in FIGS. 1 and 2, a centrifugal pump unit 10 includes a frame 11 formed to cover an engine 14 and the centrifugal pump 20, and the centrifugal pump 20 mounted on a base 12 of the frame 11.

The engine 14 includes a cylinder block 15 mounted on the base 12, a pump casing 22 of the centrifugal pump 20 is mounted on the cylinder block 15, and a crankshaft 16 has an end portion 16*a* projecting from the cylinder block 15 into the pump casing 22.

Of the crankshaft 16, a portion 16*b* located near the end portion 16*a* (i.e., near-end portion 16*b*) is rotatably supported on a mechanical seal 17, and the end portion 16*a* is connected to an impeller 31 of the centrifugal pump 20. Thus, the impeller 31 is rotatable by the crankshaft 16 (hereinafter also referred to as "rotation shaft 16") being rotated by activation of the engine 14.

The centrifugal pump 20 includes the pump casing 22 bolted to the cylinder block 15 via a partition member 21, the impeller 31 provided within the pump casing 22 and connected to the end portion 16*a* of the rotation shaft 16, and a volute 40 covering the impeller 31.

Further, the centrifugal pump 20 has a suction nozzle 35 communicating with a suction opening 25 of the pump casing 22 (i.e., casing suction opening 25), an opening/closing section 36 having an upper end portion 36*a* sandwiched between the pump casing 22 and the suction nozzle 35, and a discharge nozzle 37 communicating with a discharge opening 28 of the pump casing 22 (i.e., casing discharge opening 28).

The pump casing 22 has a casing opening section 23 closed with the partition member 21, and the volute 40 is provided on the partition member 21. Thus, an in-casing flow passage 38 is defined with the pump casing 22, the partition member 21 and the volute 40. Particularly, the in-casing flow passage 38 is defined in a substantially annular shape between the pump casing 22 and the volute 40.

Figure 3:
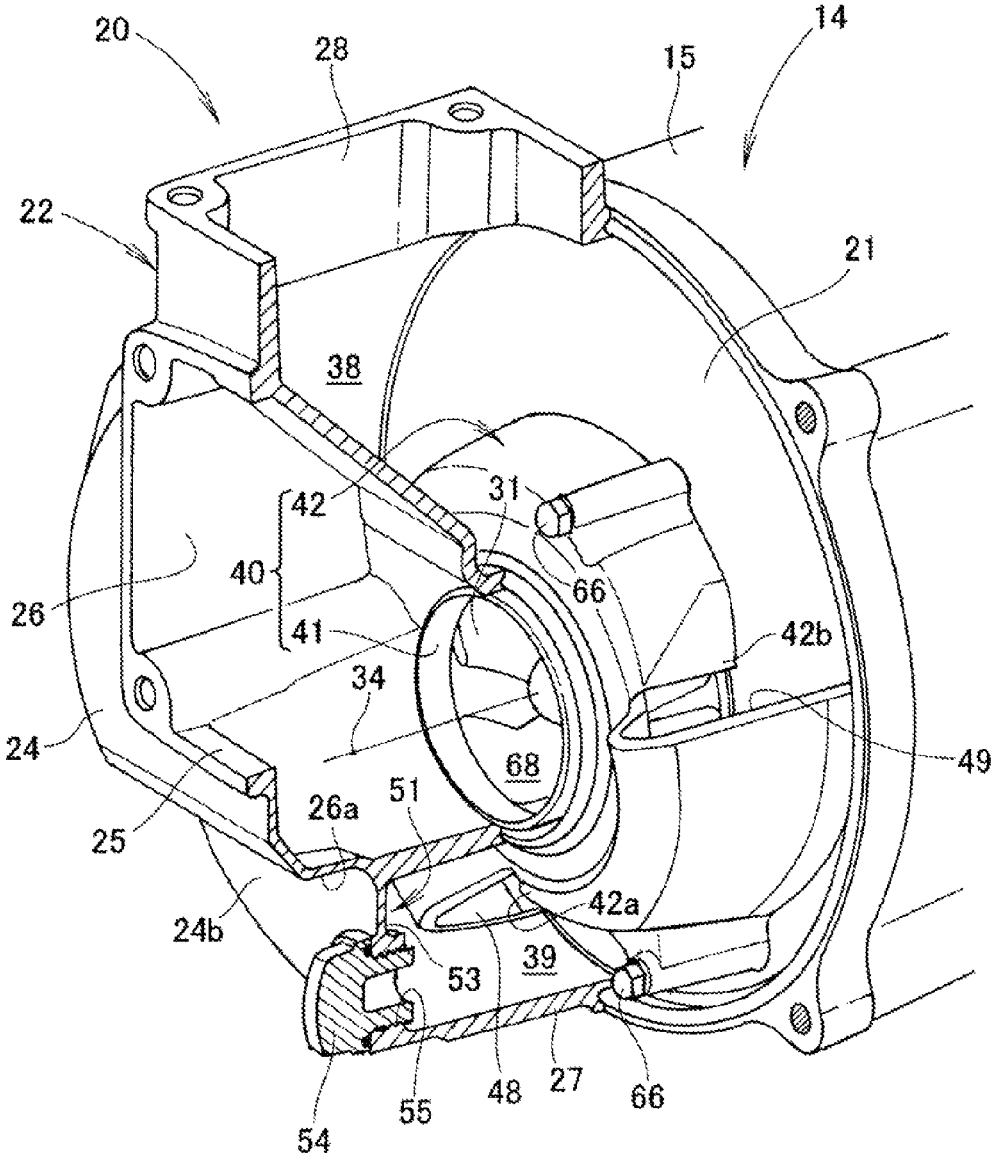
FIG. 3 is a partially-cutaway perspective view of a pump casing shown in FIG. 1.

As shown in FIGS. 2 and 3, the pump casing 22, having the casing opening section 23 closed with the partition member 21, further has: a suction-side wall section 24 facing the partition member 21; the casing suction opening 25 formed in the suction-side wall section 24; a suction passage portion 26 communicating with the casing suction opening 25; a peripheral wall section 27 formed in an annular (cylindrical) shape along side edges of the suction-side wall section 24; and the casing discharge opening 28 disposed above the peripheral wall section 27.

The suction-side wall section 24 includes a projection 51 projecting downward from a lower portion 24*b* of the wall section 24, i.e. a lower part 26*a* of the suction passage portion 26. The projection 51 projects (bulges) laterally from the lower portion 24*b* of the suction-side wall section 24 toward the in-casing flow passage 38. By the projection 51 formed integrally with the lower portion 24*b* of the suction-side wall section 24, the pump casing 22, and hence the centrifugal pump 20, can be reduced in weight and size as compared to a case where the projection 51 is formed as a separate member from the lower portion 24*b* of the suction-side wall section 24.

As shown in FIGS. 1 to 4, the projection 51 includes a top section 52 extending horizontally from the lower portion 24*b* of the suction-side wall section 24 toward the volute 40, and a wall section 53 extending vertically downward from the top section 52 to thereby face the volute 40.

Figure 4:
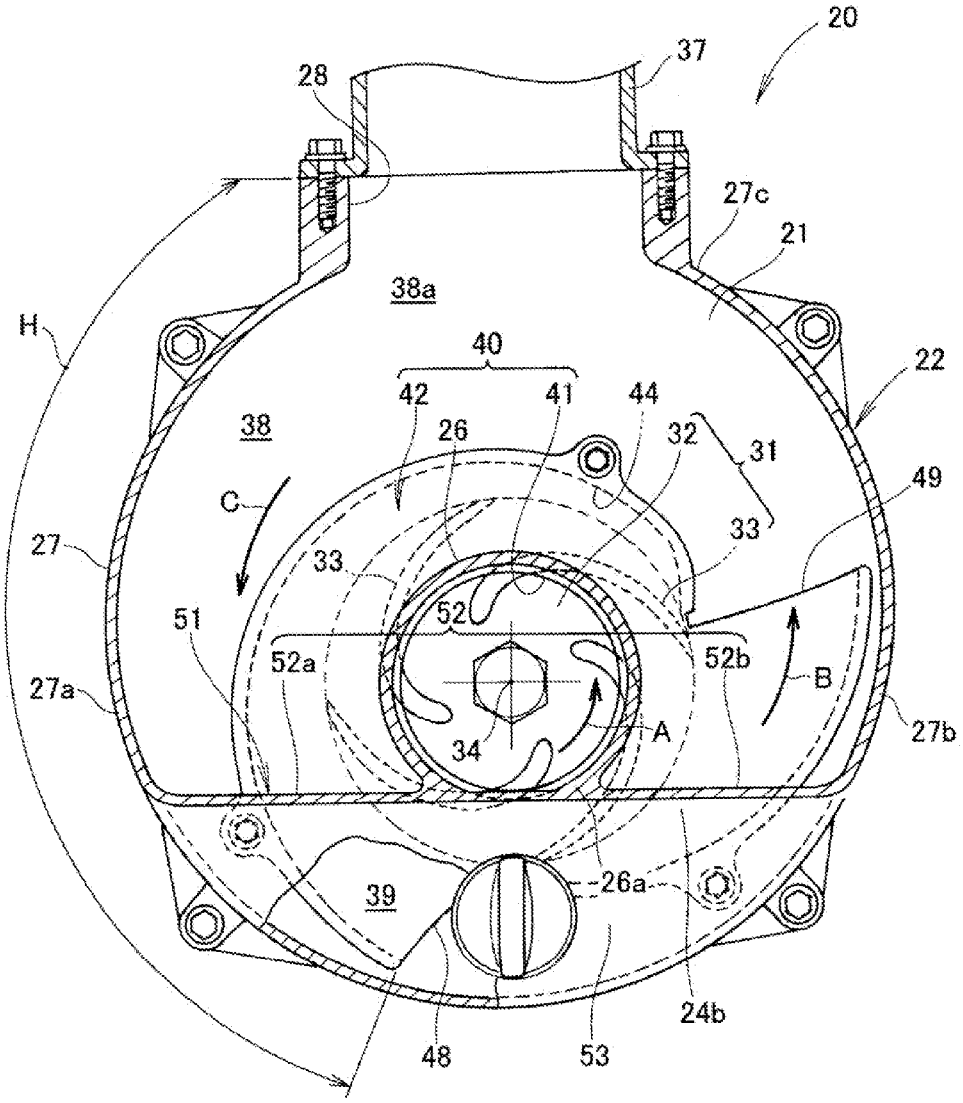
FIG. 4 is a sectional view taken along the 4-4 line of FIG. 2.

As shown in FIG. 4 that is a sectional view taken along the 4-4 line of FIG. 2, the top section 52 includes an upstream top portion 52*a* disposed between the lower part 26*a* of the suction passage portion 26 and an upstream peripheral wall portion 27*a*, and a downstream top portion 52*b* disposed between the lower part 26*a* of the suction passage portion 26 and a downstream peripheral wall portion 27*b*. The upstream peripheral wall portion 27*a* defines a portion of the in-casing flow passage 38 located upstream of an opening 48 of the volute 40. The downstream peripheral wall portion 27*b* defines a portion of the in-casing flow passage 38 located downstream of the opening 48 of the volute 40.

The upstream top portion 52*a* is disposed in a range H downstream of the casing discharge opening 28 and upstream of the opening 48 of the volute 40. Preferably, the upstream top portion 52*a* is provided on the lower part 26*a* of the suction passage portion 26 in the range H.

Further, the wall section 53 extends downward from an edge portion of the top section 52 and has an upper edge portion formed straight along the top section 52 and a lower edge portion curved along a lower portion of the peripheral wall section 27; thus, the wall section 53 generally has a half-moon shape. The wall section 53 also has a drain hole 55 that is closed with a drain plug 54 screwed thereto.

Further, with the projection 51 provided on the lower part 24*b* of the suction-side wall section 24, a flow-passage narrowing portion 39 is formed in a lower portion of the in-casing flow passage 38, and the flow-passage narrowing portion 39 has a smaller sectional area (flow passage sectional area) than the remaining portions of the in-casing flow passage 38. Further, the flow-passage narrowing portion 39 is located beneath the rotation axis 34 of the impeller 31, more specifically beneath a suction opening 41 of the volute 40 (i.e., volute suction opening 41), and at generally the same height as the opening 48 of the volute 40. In this manner, the opening 48 of the volute 40 is in communication with the flow-passage narrowing portion 39.

Further, the casing suction opening 25 is provided in the suction-side wall section 24, and the suction passage portion 26 is in communication with the casing suction opening 25. The suction passage portion 26 is in communication with the volute suction opening 41. Further, the volute suction opening 41 is in communication with the suction nozzle 35 by way of the suction passage portion 26 and the casing suction opening 25.

Further, the pump casing discharge opening 28 is provided in an upper portion 27*c* of the peripheral wall section 27, and the discharge nozzle 37 is in communication with the pump casing discharge opening 28. A fluid feed opening 61 is provided in an upper end portion of the discharge nozzle 37 and located over the volute 40, and this fluid feed opening 61 is closed with a feed plug 62.

Further, the partition member 21 has a support hole 21*a* formed therein concentrically with the rotation shaft 16, and the mechanical seal 17 is concentrically supported in the support hole 21*a*, and the rotation shaft 16 (more specifically, the near-end portion 16*b*) is rotatably supported on the mechanical seal 17. Further, the end portion 16*a* of the rotation shaft 16 projects through the mechanical seal 17 into the volute 40. Thus, the mechanical seal 17 can mechanically prevent fluid present within the volute 40 from leaking outside via the near-end portion 16*b*.

The impeller 31 is mounted on the rotation shaft's end portion 16*a* projecting into the volute 40, so that the impeller 31 is disposed inside the volute 40. The impeller 31 includes a disk-shaped hub 32 mounted on the end portion 16*a*, and a plurality of vanes 33 provided on the hub 32 in a radial arrangement about the rotation shaft 16. The plurality of vanes 33 are provided on a surface portion 32*a* of the hub 32 opposite from the mechanical seal 17. The impeller 31 is accommodated inside the volute 40 by being covered with the volute 40.

The volute 40 is fixed to the partition member 21 by means of bolts 66. The volute 40 is a case member provided within the pump casing 22 and accommodating therein the impeller 31. An in-volute flow passage 68 is defined with the volute 40 and the partition member 21. The volute 40 includes the suction opening 41 provided in communication with the suction passage portion 26 of the pump casing 22, and a volute body 42 has a spiral shape and disposed around the suction opening 41 (impeller 31).

The volute body 42 has a generally flat opposed surface 43 that is opposed to respective end surfaces 33*a*, in a rotation axis direction, of the vanes 33 (i.e., respective axial end surfaces 33*a* of the vanes 33). The volute body 42 has the opening 48 formed in a lower end portion 42*a* thereof, and a volute discharge opening 49 formed in a left upper portion 42*b* thereof. The opening 48 is provided for directing priming fluid, present in the in-casing flow passage 38, into the volute 40 (i.e., into the in-volute flow passage 68).

During self-priming of the centrifugal pump 20, the priming fluid is fed through the fluid feed opening 61 into the in-volute flow passage 68 with the feed plug 62 removed. The priming fluid thus fed into the in-casing flow passage 38 is discharged through the volute discharge opening 39 together with gases present in the in-volute flow passage 68 and then directed into the in-casing flow passage 38. Note that the "priming fluid" is fluid that performs a pump-priming action during the self-priming operation of the centrifugal pump 20.

More specifically, during the self-priming, priming fluid fed to the in-casing flow passage 38 is sucked into the in-volute flow passage 68 through the volute opening 48 by the impeller 31 being rotated as indicated by arrow A. Gases present in the in-volute flow passage 68 are incorporated as air bubbles into the fluid sucked into the in-volute flow passage 68. The fluid containing such air bubbles is discharged through the volute discharge opening 49 as indicated by arrow B and directed to an upper portion 38*a* of the in-casing flow passage 38, so that the gases present as the air bubbles are separated from the priming fluid and discharged to outside of the centrifugal pump 20 through the casing discharge opening 28 and the discharge nozzle 37. Further, the fluid having the gases separated therefrom as above flows as indicated by arrow C.

During steady operation of the centrifugal pump 20, on the other hand, fluid directed through the volute suction opening 41 into the in-volute flow passage 68 is discharged through the volute discharge opening 39 and directed into the in-casing flow passage 38. The opening/closing section 36 has the upper end portion sandwiched between the pump casing 22 and the suction nozzle 35, as noted above. The suction nozzle 35 opens or closes in response to the opening/closing section 36 pivoting in an arrowed direction of FIG. 2.

More specifically, during the steady operation of the pump 20, fluid is sucked through the volute suction opening 41 into the in-volute flow passage 68 by the impeller 31 being rotated in the direction of arrow A in FIG. 4. The fluid thus sucked into the in-volute flow passage 68 is discharged through the volute discharge opening 49 as indicated by arrow B. The fluid thus discharged through the volute discharge opening 49 into the in-casing flow passage 38 is sent through the casing discharge opening 28 to the discharge nozzle 37.

Figure 5:
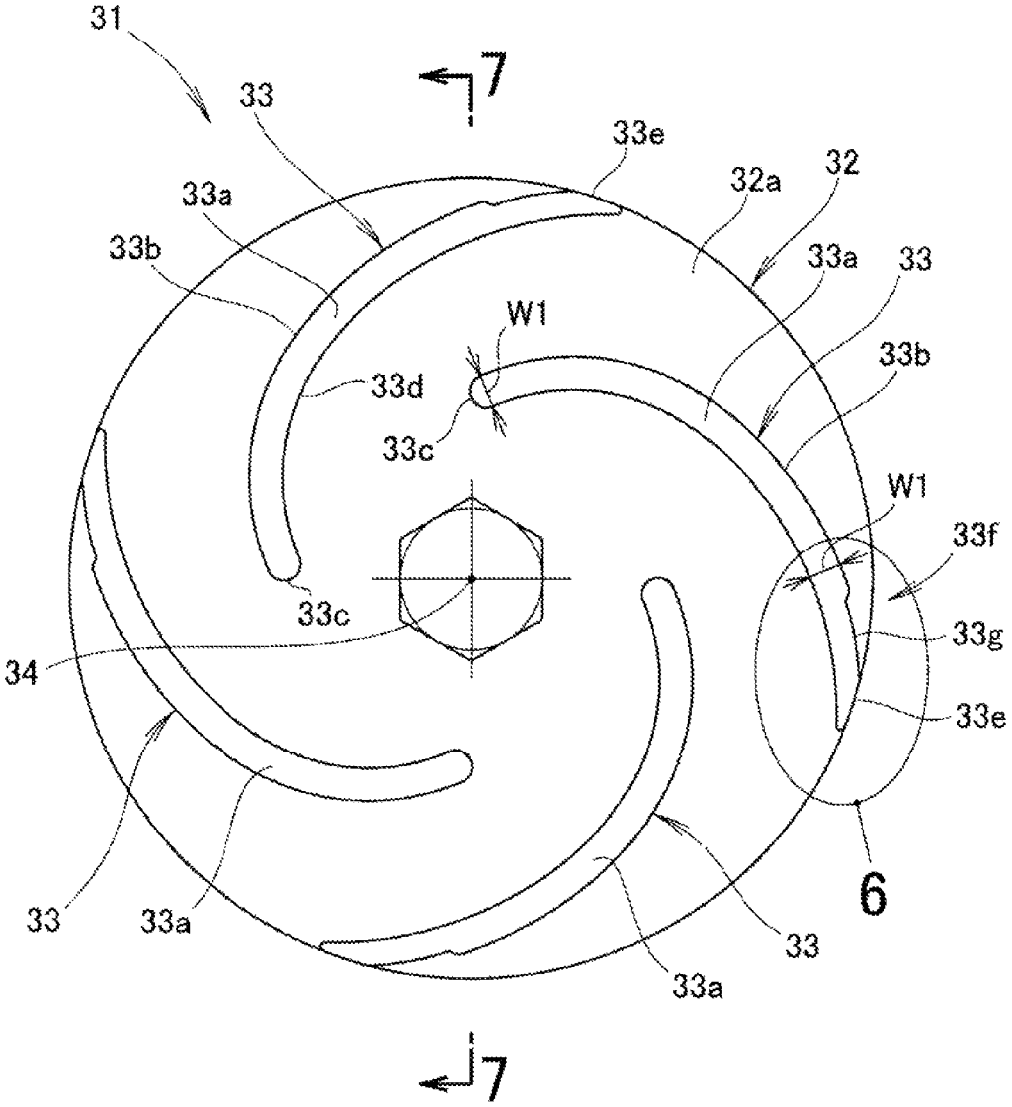
FIG. 5 is a front view of an impeller shown in FIG. 4.

The following detail, with reference to FIGS. 4 to 7, the impeller 31 provided in the instant embodiment. As shown in FIGS. 4 and 5, the impeller 31 includes the disk-shaped hub 32, and the plurality of (four in the illustrated example) vanes 33 provided on the surface 32*a* of the hub 32. These vanes 33 are formed generally in a whirling configuration or pattern about the center of rotation 34 of the impeller 31. Each of the vanes 33 has: an outer peripheral surface (front surface) 33*b* facing the inner peripheral surface 44 of the volute 40; a front curved surface 33*c* defining a front end portion in the rotational direction (i.e., rotational-direction front end portion); a reverse surface 33*d* formed continuously with the front curved surface 33*c* and located behind the outer peripheral surface 33*b*; a rear end surface 33*e* defining a rear end portion in the rotational direction (i.e., rotational-direction rear end portion); and the aforementioned axial end surface 33*a*.

Further, as shown in FIG. 5, the reverse surface 33*d* of each of the vanes 33 is formed to extend along the outer peripheral surface 33*b*. Each of the vanes 33 is formed so that a thickness or width W1 between the outer peripheral surface 33*b* and the reverse surface 33*d* is uniform from the rotational-direction front end portion to the rotational-direction rear end portion. Further, a rotational-direction rear end portion 33*f* of the outer peripheral surface 33*b* has a recessed surface 33*g* of a stepped portion (i.e., recessed step surface 33*g*) of the outer peripheral surface 33*b*.

Note that, whereas each of the vanes 33 of the impeller 31 in the instant embodiment has been shown and described as formed in such a manner that the width W1 between the outer peripheral surface 33*b* and the reverse surface 33*d* is uniform from the rotational-direction front end portion to the rotational-direction rear end portion, the present invention is not so limited, and the width in the rotational-direction front end portion of the vane 33 may be made greater than the width in the rotational-direction rear end portion of the vane 33. Further, each of the vanes 33 may be curved three dimensionally.

Figure 6:
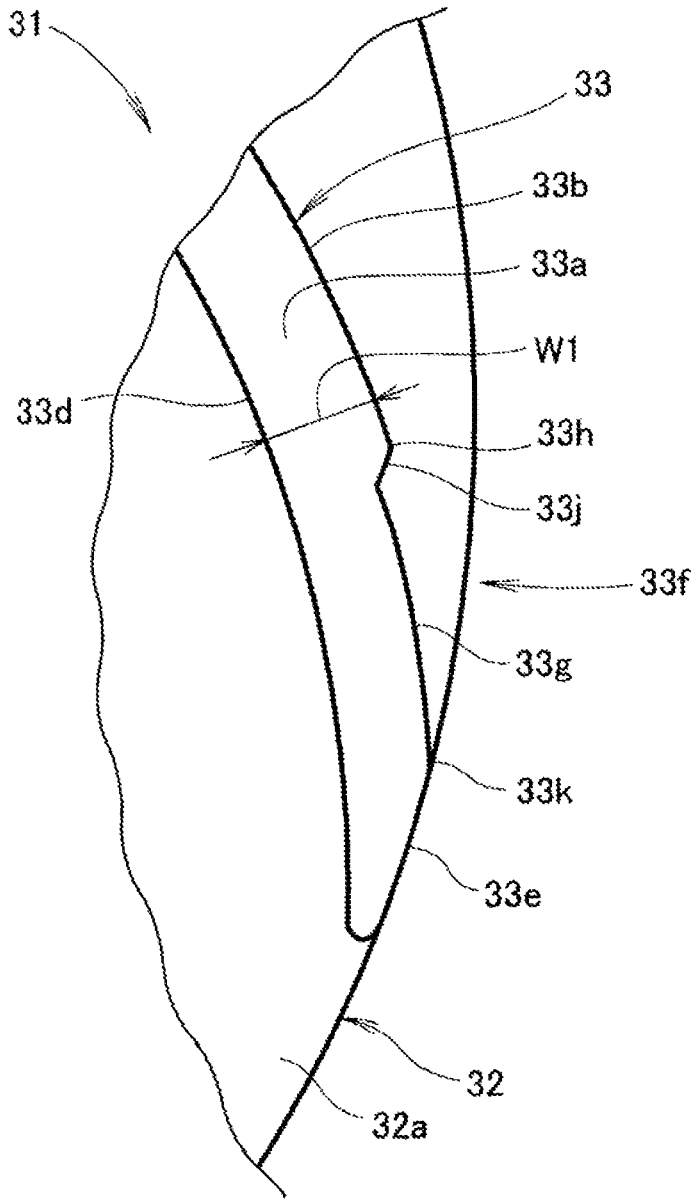
FIG. 6 is a view showing in enlarged scale of a section encircled at 6 in FIG. 5.

Further, as shown in FIG. 6, the rotational-direction rear end portion 33*f* of the outer peripheral surface 33*b* of each of the vanes 33 includes: a first top portion 33*h* formed at the rear end of a region thereof where the width between the reverse surface 33*d* and the outer peripheral surface 33*b* is set at W1; an intermediate surface 33*j* slantingly extending from the first top portion 33*h* to the recessed step surface 33*g*; the recessed step surface 33*g* integrally connecting with the slanting intermediate surface 33*j*; and a second top portion 33*k* formed at a rotational-direction rear end of the recessed step surface 33*g*.

The rear end of the region where the uniform width W1 is set between the reverse surface 33*d* and the outer peripheral surface 33*b* is formed to define an edge shape with respect the intermediate surface 33*j*. Further, the rotational-direction rear end of the recessed step surface 33*g* is formed to define an edge shape with respect to the rotational-direction rear end 33*e*.

Figure 7:
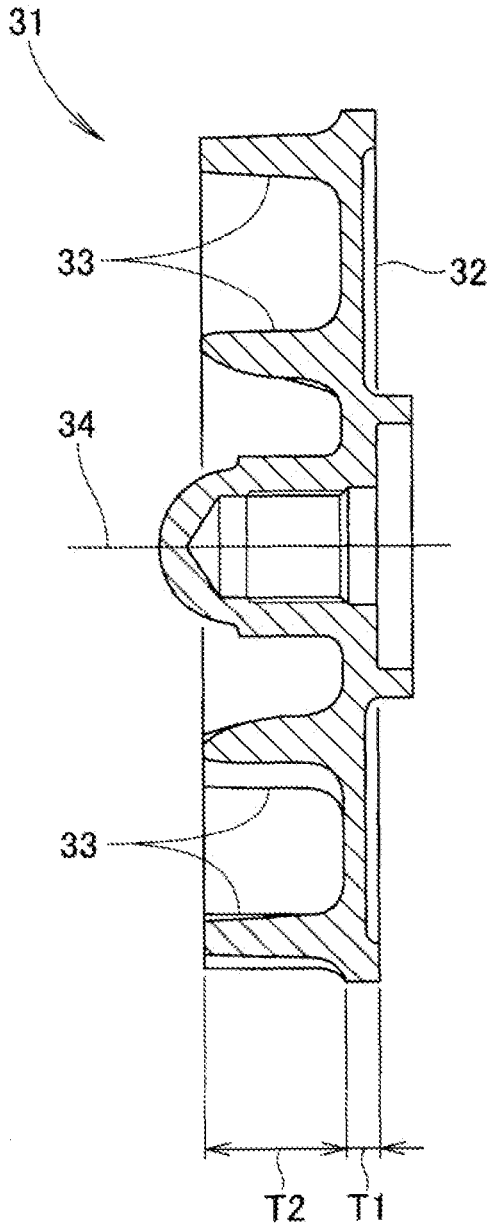
FIG. 7 is a sectional view taken along the 7-7 line of FIG. 5.

Further, as shown in FIG. 7, the hub 32 of the impeller 31 has an axial height T1, and each of the vanes 33 has an axial height T2. Note that, whereas each of the vanes 33 has been shown as having a uniform axial height T2 from the rotational-direction front end portion to the rotational-direction rear end portion, the present invention is not so limited, and the axial height at the rotational-direction front end portion of each of the vanes 33 and the axial height at the rotational-direction rear end portion of the vane 33 may be made different from each other.

Figure 8:
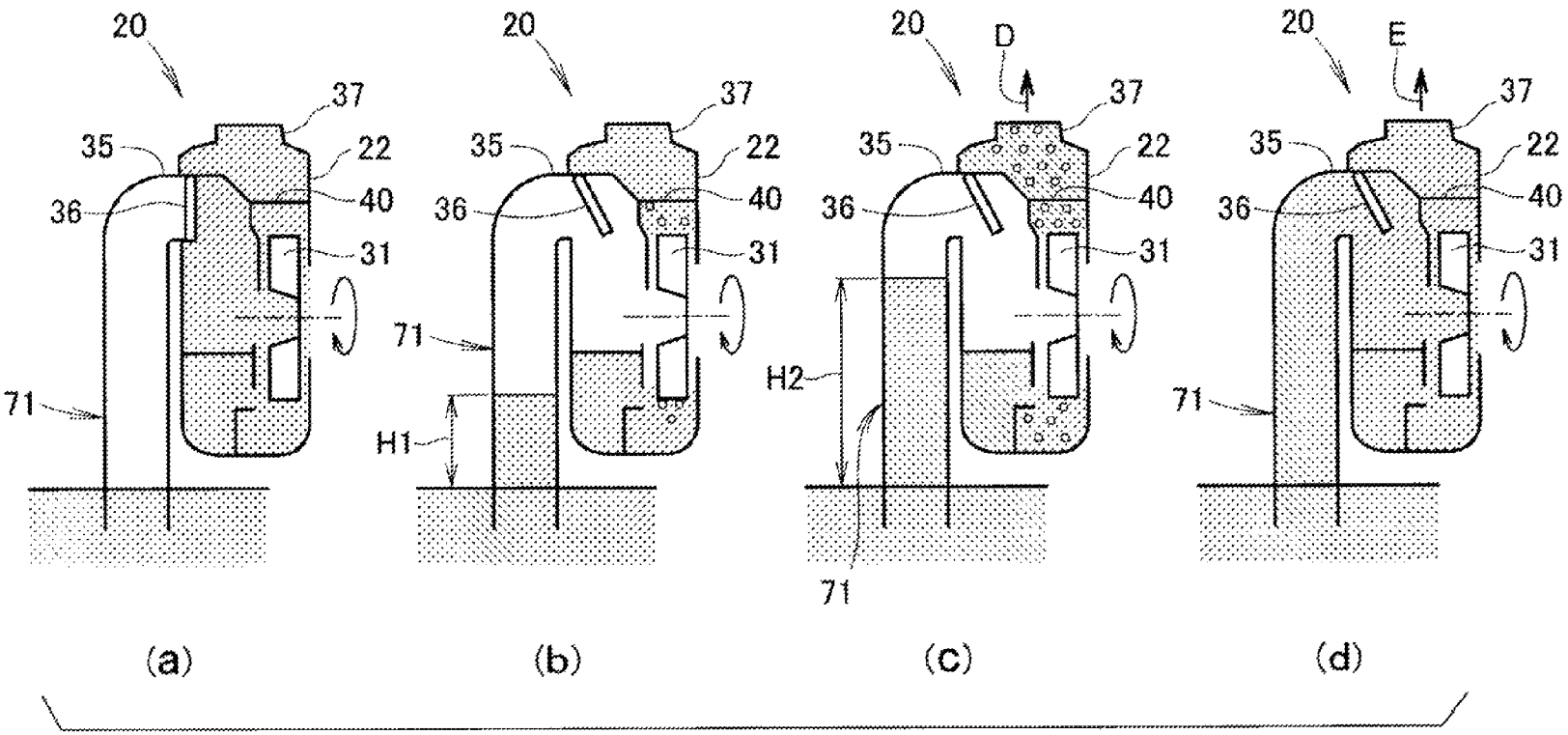
FIG. 8 is a view explanatory of behavior of the embodiment of the centrifugal pump.

Next, a description will be given about behavior of the embodiment of the centrifugal pump 20 constructed in the above-described manner. (a) to (c) of FIG. 8 are explanatory of self-priming operation of the centrifugal pump. First, as shown in (a) of FIG. 8, priming water is fed into the pump casing 22 to fill the pump casing 22 with the priming water. Because the opening/closing section 36 is kept in the closed state during that time, the priming water filling the pump casing 22 will not flowing through the suction nozzle 35 into a hose 71.

Then, as the impeller 31 is rotated, gases within the hose 71 are introduced into the fed priming water, so that fluid within the hose 71 is pulled up to a fluid level height H1, as shown in (b) of FIG. 8.

Then, as shown in (c) of FIG. 8, the gases introduced into the priming water within the pump casing 22 are separated from the priming water in an upper interior portion of the pump casing 22 and discharged through the discharge nozzle 37 as indicated by arrow D. Also, the fluid within the hose 71 is further pulled up to a fluid level height H2.

(d) of FIG. 8 is a view explanatory of steady operation of the centrifugal pump 20. As shown in (d) of FIG. 8, all gases within the hose 71 are discharged. Then, transportation of the fluid is started, and the fluid is discharged through the discharge nozzle 37 as indicated by arrow E.

Figure 9:
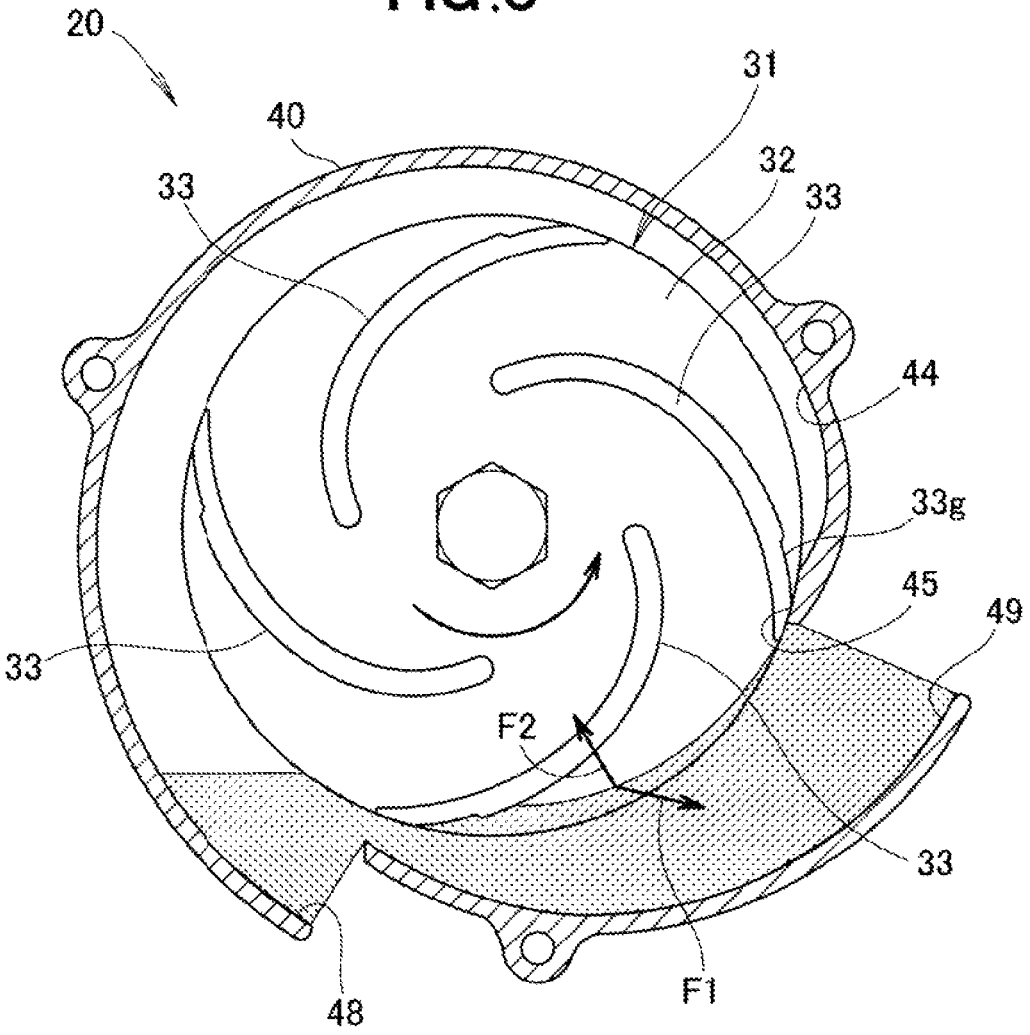
FIG. 9 is a view explanatory of behavior of the impeller shown in FIG. 5.

The following describe, with reference to FIG. 9, behavior of the impeller during the self-priming operation of the centrifugal pump 20. As the impeller 31 is rotated, force F1 created by centrifugal force of the impeller 31 and centripetal force F2 created by suction negative pressure acts on priming water within the volute 40. The priming water is transported along the rotating direction of the impeller 31 to a volute tongue portion 45 of the volute discharge opening 49.

The following comparatively describe swirling flows developed during the self-priming operation in a conventionally-known example of a centrifugal pump and swirling flows developed during the self-priming operation in the embodiment of the centrifugal pump 20 ("INVENTIVE EMBODIMENT").

Figure 10:
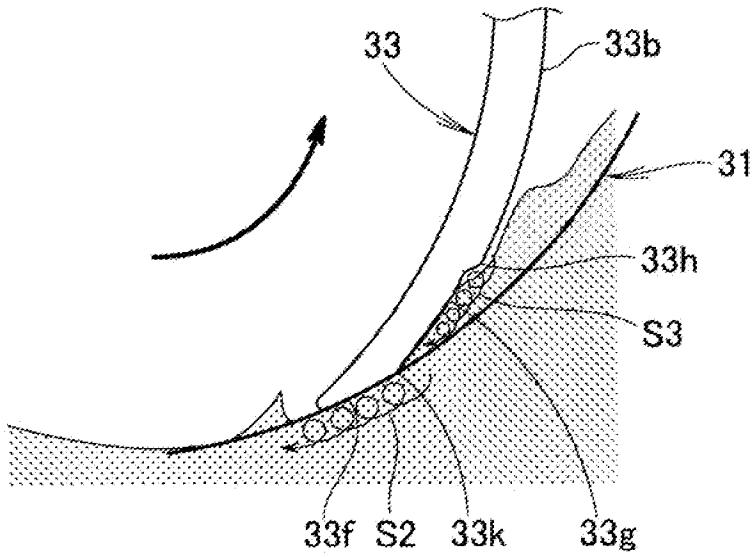
FIG. 10 is a view explanatory of behavior of swirling currents occurring near a recessed step surface of a vane shown in FIG. 9.
Figure 10:
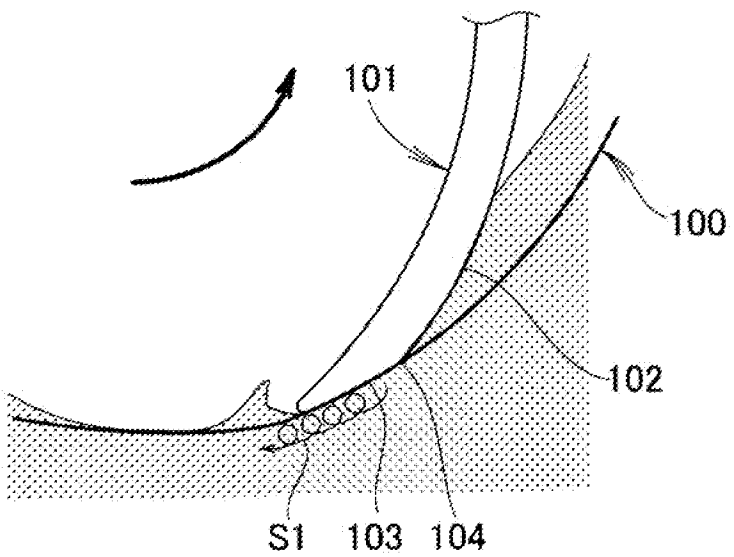

(a) of FIG. 10 is a view explanatory of swirling flows developed by an impeller in the conventionally-known example. Each vane 101 of the impeller 100 in the conventionally-known example has one top portion 104 located between the outer peripheral surface 102 and the rotational-direction rear end surface 103. As the impeller 100 is rotated, swirling flows S1 are developed near the top portion 104. Because of such swirling flows S1, air within a volute is entrained so that self-priming is performed.

(b) of FIG. 10 is a view explanatory of swirling flows developed by the impeller 31 in the embodiment. As the impeller 31 is rotated, priming water enters toward the center of the impeller 31, due to decrease of suction pressure in the neighborhood of the recessed step surfaced 33*g* of the vane 33, to such a degree that the recessed step surfaced 33*g* is flooded with the priming water. Preliminary swirling flows S3 are developed near the first top portion 33*h*, and swirling flows S2 are developed near the second top portion 33*k*. Because of these preliminary swirling flows S3 and swirling flows S2, a large amount of air is entrained, so that self-priming operation is performed. Namely, the impeller 31 in the instant embodiment can develop greater swirling flows than the impeller 100 in the conventionally-known example of the centrifugal pump 100. As a result, the instant embodiment can achieve enhanced gas-liquid mixing performance even when a self-priming pump head has got higher.

Figure 11:
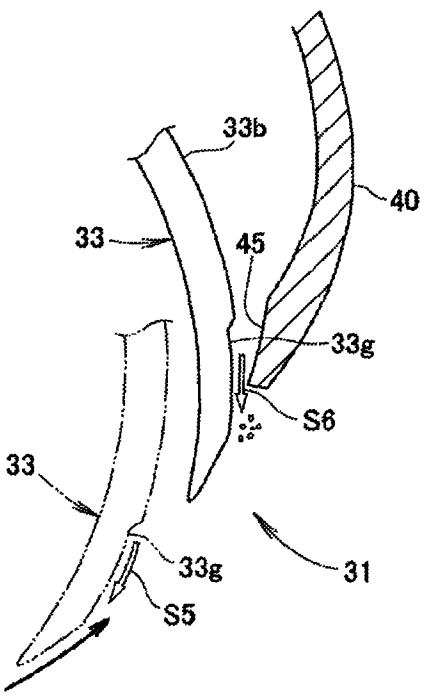
FIG. 11 is a view explanatory of behavior of cavitation occurring near the recessed step surface of the vane shown in FIG. 9.
Figure 11:
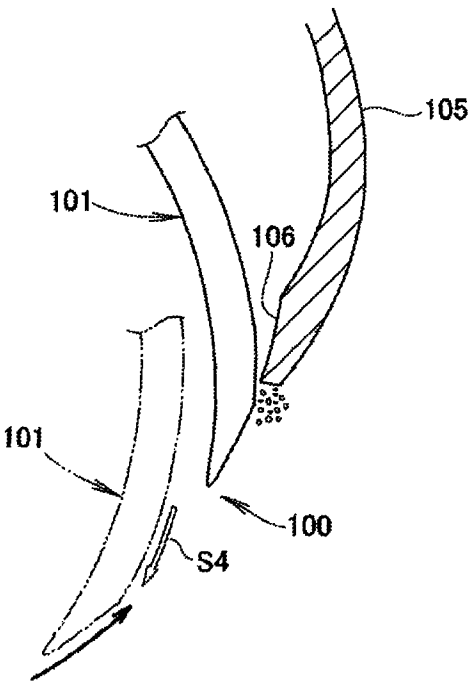

The following comparatively describe cavitation in the conventionally-known example of the centrifugal pump 100 and cavitation in the embodiment of the centrifugal pump 20. (a) of FIG. 11 is a view explanatory of cavitation in the conventionally-known example of the centrifugal pump 100. As the impeller 100 is rotated in the conventionally-known example, fluid flows along the vane 101 as indicated by arrow S4. Once the vane 101 moves to near a volute tongue portion 106, flows of the fluid are stopped rapidly by the volute tongue portion 106, so that cavitation (air bubbles) would occur.

(b) of FIG. 11 is a view explanatory of cavitation in the embodiment of the centrifugal pump 20. As the impeller 33 is rotated in the embodiment of the centrifugal pump 20, fluid flows along the vane 33 as indicated by arrow S5. Even when the vane 33 has moved to near the volute tongue portion 45 into the same phase as the vane 101 in the conventionally-known example shown in (a) of FIG. 11, the fluid would flow, without being stopped rapidly, as indicated by arrow S6, because the recessed step surface 33*g* provides an escapeway for the fluid. Namely, stoppage, by the volute tongue portion 45, of the fluid flows can be alleviated, so that occurrence of cavitation (air bubbles) can be suppressed.

The following summarize the above-described embodiment of the centrifugal pump 20. Because the rotational-direction rear end portion 33*f* of each of the vanes 33 has the recessed step surface 33*g* formed thereon as shown in FIGS. 5 and 6, swirling flows can be developed at a boundary portion of the outer peripheral surface 33*b* where the outer peripheral surface 33*b* starts switching to the recessed step surface 33*g* and at a rear end portion of the recessed step surface 33*g*. Thus, great swirling flows can be developed to entrain air present within the volute 40, as a result of which the instant embodiment can achieve enhanced self-priming performance.

Further, because the rotational-direction rear end portion 33*f* of the outer peripheral surface 33*b* in each of the vanes 33 has the recessed step surface 33*g* formed thereon, stoppage of the fluid can be alleviated in a stepwise fashion over a region where the vane 33 progressively approaches the inner peripheral surface 44 of the volute 40, so that occurrence of cavitation can be suppressed. Namely, the instant embodiment can not only effectively suppress occurrence of vibration but also achieve enhanced self-priming performance.

Of the recessed step surface 33*g* of each of the vanes 33, the rotational-direction rear end is formed to define an edge shape with respect to the rotational-direction rear end surface 33*e* as shown in FIGS. 5 and 6, the instant embodiment can develop great swirling flows by changing fluid flows, thereby even further enhancing the self-priming performance.

Whereas the impeller 31 has been shown and described above as having four vanes 33, the present invention is not so limited, and the number of the vanes 33 may be five, six or the like. Furthermore, whereas the vanes 33 are formed in a whirling pattern about the center of rotation 34 of the impeller 31, the present invention is not so limited, and the whole of each of the vanes 33 may be formed in a straight shape.

The basic principles of the present disclosure are well suited for application to centrifugal pumps in which include an impeller is provided within a volute and sucked into the volute by rotation of the impeller is discharged to outside of the centrifugal pump.

What is claimed is:

1. A centrifugal pump comprising a volute provided within a pump casing, and an impeller rotatably provided within the volute, fluid sucked into the volute through rotation of the impeller being sent from the volute into the pump casing and then discharged to outside of the pump casing, the impeller including a disk-shaped hub and a plurality of vanes provided radially on a surface of the hub, the plurality of vanes being formed in a whirling pattern about a center of rotation of the impeller, each of the vanes having an outer peripheral surface facing an inner peripheral surface of the volute and having a reverse surface formed behind the outer peripheral surface, a rotational-direction rear end portion of the outer peripheral surface having a recessed step surface that is formed thereon and recesses to a side of the reverse surface over an entire height along an axial direction of the hub, the rotational-direction rear end portion including: a first top portion in which a width between the reverse surface and the outer peripheral surface is set a predetermine width and which develops swirling flows; an intermediate surface extending from the first top portion to the recessed step surface; the recessed step surface integrally connecting with the intermediate surface and extending along the reverse surface; and a second top portion formed at a rotational-direction rear end of the recessed step surface and developing swirling flows.

2. The centrifugal pump according to claim 1, wherein the rotational-direction rear end of the recessed step surface of each of the vanes is formed to define an edge shape with respect to a rotational-direction rear end surface of the vane.

* * * * *